US009081349B2

(12) United States Patent
Saitou

(10) Patent No.: US 9,081,349 B2
(45) Date of Patent: Jul. 14, 2015

(54) IMAGE FORMING APPARATUS AND IMAGE FORMING METHOD

(75) Inventor: Seiji Saitou, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 442 days.

(21) Appl. No.: 13/151,414

(22) Filed: Jun. 2, 2011

(65) Prior Publication Data

US 2011/0304881 A1 Dec. 15, 2011

Related U.S. Application Data

(60) Provisional application No. 61/353,292, filed on Jun. 10, 2010.

(30) Foreign Application Priority Data

Apr. 18, 2011 (JP) ..... P2011-91766

(51) Int. Cl.
*G03G 15/00* (2006.01)
*B41J 11/00* (2006.01)
*B41J 11/48* (2006.01)

(52) U.S. Cl.
CPC ..... *G03G 15/6508* (2013.01); *B41J 11/008* (2013.01); *B41J 11/485* (2013.01)

(58) Field of Classification Search
None
See application file for complete search history.

(56) References Cited

U.S. PATENT DOCUMENTS 7,782,508 B2 8/2010 Kondo
8,081,347 B2 12/2011 Tamada et al.
(Continued)

FOREIGN PATENT DOCUMENTS

JP 07-114309 5/1995
JP 07-234617 9/1995
JP 11-268409 10/1999
JP 2007-282061 10/2007
(Continued)

OTHER PUBLICATIONS

Japanese Office Action for Japanese Application No. 2011-091766 mailed on Nov. 26, 2013.

*Primary Examiner* — Ashish K Thomas
*Assistant Examiner* — Keara Harris
(74) *Attorney, Agent, or Firm* — Amin, Turocy & Watson, LLP

(57) ABSTRACT

According to an embodiment, an image forming apparatus includes a plurality of recording medium housing portions in which recording mediums to be reused are discriminated and housed respectively for degradation regions that are erased image regions; an obtaining unit to obtain image data; a printing region discriminating unit to discriminate a printing region at the time of printing from the obtained image data to the recording medium; a selecting unit to select the recording medium housing portion in which the recording medium not including the degradation region corresponding to the printing region discriminated by the printing region discriminating unit is housed from a plurality of the recording medium housing portions; and a printing portion to print the image data obtained in the obtaining unit on the recording medium fed from the recording medium housing portion which is selected by the selecting unit.

19 Claims, 8 Drawing Sheets

(56) References Cited

U.S. PATENT DOCUMENTS

| | | | | |
|---|---|---|---|---|
| 8,538,317 | B2 | 9/2013 | Iguchi | |
| 2007/0035789 | A1* | 2/2007 | Ohkawa | 358/522 |
| 2007/0236720 | A1* | 10/2007 | Tamada et al. | 358/1.14 |
| 2008/0088861 | A1 | 4/2008 | Kondo | |
| 2009/0086219 | A1* | 4/2009 | Nagashima | 358/1.5 |
| 2010/0118361 | A1 | 5/2010 | Iguchi | |

FOREIGN PATENT DOCUMENTS

| | | |
|---|---|---|
| JP | 2008-100772 | 5/2008 |
| JP | 2008-124688 | 5/2008 |
| JP | 2010-113337 | 5/2010 |

* cited by examiner

| RECORDING MEDIUM HOUSING PORTION | RECORDING SHEET TO BE HOUSED |
|---|---|
| RECORDING SHEET TRAY 31 | RECORDING SHEET HAVING DEGRADATION REGION PATTERN 1 |
| RECORDING SHEET TRAY 32 | RECORDING SHEET HAVING DEGRADATION REGION PATTERN 2 |
| RECORDING SHEET TRAY 33 | RECORDING SHEET HAVING DEGRADATION REGION PATTERN 3 |
| RECORDING SHEET TRAY 34 | RECORDING SHEET HAVING DEGRADATION REGION PATTERN 4 |
| RECORDING SHEET TRAY 35 | RECORDING SHEET HAVING DEGRADATION REGION PATTERN 5 |

FIG. 5

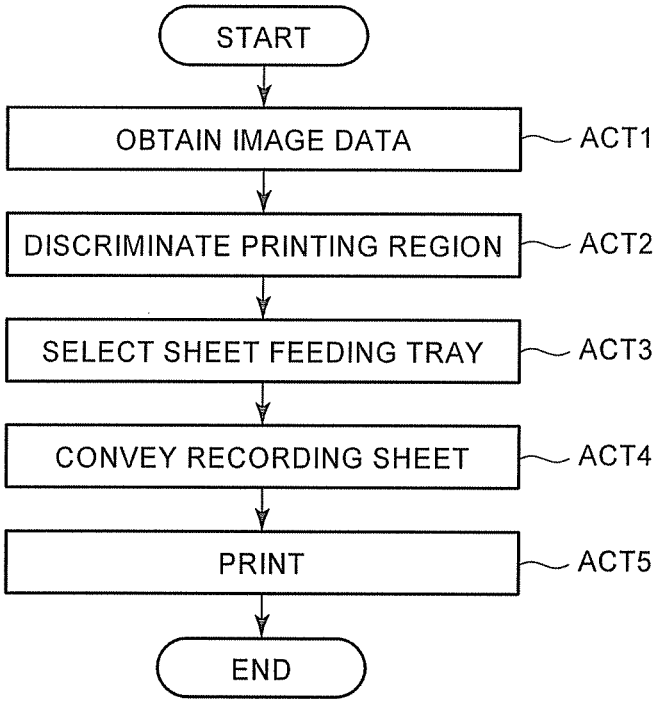

FIG. 6

| PRINTING REGION | SELECTING ORDER OF DEGRADATION REGION PATTERN OF RECORDING SHEET | | | |
|---|---|---|---|---|
| | PRIORITY 1 | PRIORITY 2 | PRIORITY 3 | PRIORITY 4 |
| REGION 1 | PATTERN 3 | PATTERN 4 | PATTERN 2 | PATTERN 1 |
| REGION 2 | PATTERN 5 | PATTERN 2 | PATTERN 1 | — |
| REGION 3 | PATTERN 3 AND IMAGE ROTATION | PATTERN 4 AND IMAGE ROTATION | PATTERN 2 AND IMAGE ROTATION | PATTERN 1 |
| REGION 1 + REGION 2 | PATTERN 2 | PATTERN 1 | — | — |
| REGION 1 + REGION 3 | PATTERN 4 | PATTERN 1 | — | — |
| REGION 2 + REGION 3 | PATTERN 2 AND IMAGE ROTATION | PATTERN 1 | — | — |
| REGION 1 + REGION 2 + REGION 3 | PATTERN 1 | — | — | — |

FIG. 7

| DISCRIMINATION VALUE | CORRESPONDING DEGRADATION REGION PATTERN |
|---|---|
| 0 | DEGRADATION REGION PATTERN 1 |
| 1 OR 5 | DEGRADATION REGION PATTERN 2 |
| 4 OR 8 | DEGRADATION REGION PATTERN 3 |
| 3 | DEGRADATION REGION PATTERN 4 |
| 6 | DEGRADATION REGION PATTERN 5 |

FIG. 10

IMAGE FORMING APPARATUS AND IMAGE FORMING METHOD

CROSS-REFERENCE TO RELATED APPLICATION

The application is based upon and claims the benefit of priority from U.S. Provisional Application No. 61/353,292, filed Jun. 10, 2010; further this application is based upon and claims the benefit of priority from Japanese Patent Application No. P2011-91766, filed on Apr. 18, 2011; the entire contents of which are incorporated herein by references.

FIELD

Embodiments of the present invention relate to an image forming apparatus and an image forming method which erases an image printed on a sheet using an erasable recording material and reuses the sheet.

BACKGROUND

In recent years, the necessity of reducing the amount of paper consumption is increasing in order to reduce environmental burdens and to reduce the amount of CO2 emissions. For this reason, image forming apparatuses are known which can reuse a sheet by forming an image on the sheet using an erasable recording material and then erasing the image by adding heat and light to the sheet on which the image has been once formed.

In addition, apparatuses are known which count the number of passages of the sheet which has passed through an erasing device, at the time of erasing the image which has been formed using the erasable recording material like this with an erasing device, and inhibit the reuse of the sheet with more than a prescribed number of passages because of causing a jam.

However, though by combining the image forming apparatus and the erasing device like these, to reuse the papers can be implemented, and concurrently the generation of jams due the damage of the sheet that is the physical stress applied to the sheets, such as folds and rucks can be reduced, a problem still remains that the printing quality degrades by printing the image on the partially degraded sheet.

BRIEF DESCRIPTION OF THE DRAWINGS

FIG. 5 is a diagram to describe the recording sheets housed in the recording medium housing portions.

FIG. 6 is a flow chart showing an image forming processing according to the embodiment of the present invention.

FIG. 7 is a diagram to describe the content of the table to select the recording sheets from the printing regions.

FIG. 10 is a diagram to describe the content of the table to discriminate the degradation regions.

DETAILED DESCRIPTION

A problem to be solved by this embodiment is to provide an image forming apparatus and an image forming method which can form an image with high quality even in case that the image is formed reusing a partially degraded sheet as a result of passing through an erasing device.

According to an embodiment, an image forming apparatus includes a plurality of recording medium housing portions in which recording mediums to be reused are discriminated and housed respectively for degradation regions that are erased image regions; an obtaining unit to obtain image data; a printing region discriminating unit to discriminate a printing region at the time of printing from the obtained image data to the recording medium; a selecting unit to select the recording medium housing portion in which the recording medium not including the degradation region corresponding to the printing region discriminated by the printing region discriminating unit is housed from a plurality of the recording medium housing portions; and a printing portion to print the image data obtained in the obtaining unit on the recording medium fed from the recording medium housing portion which is selected by the selecting unit.

Hereinafter, an embodiment of the present invention will be described with reference to the drawings.

Figure 1:
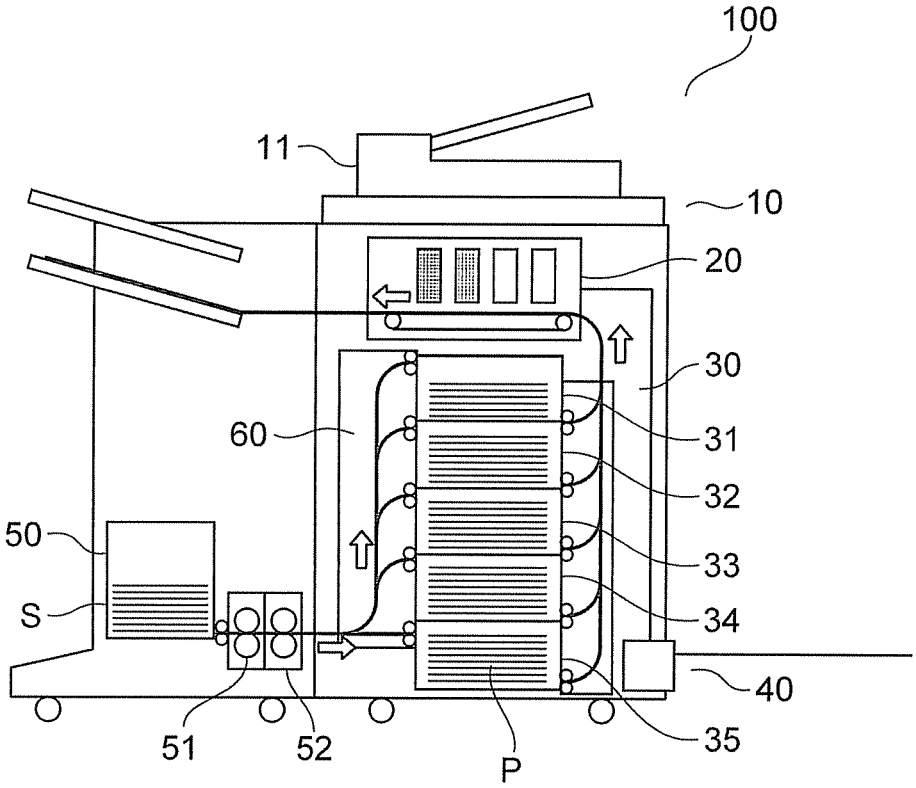
FIG. 1 is a sectional view showing a construction of an image forming apparatus according to an embodiment of the present invention.

FIG. 1 is a sectional view showing a construction of an image forming apparatus of en embodiment of the present invention. A complex machine (hereinafter, stated as an MFP) that is an image forming apparatus includes a document reading portion 10 which reads in optically a document while conveying the documents which are set in an automatic document sending device 11 one by one, or reads in optically a document which is set in a platen not shown in the drawing, and thereby generates image data, a printing portion 20 which discharges inks of C (cyan), M (magenta), Y (yellow), K (black) from an ink head not shown in the drawing on a conveyed recording sheet P as a recording medium and prints the image, a recording sheet conveying portion 30 which conveys the recording sheet P fed from one of sheet feeding trays 31 to 35 that are recording medium housing portions to the printing portion 20, and an external information input portion 40 which receives print data transmitted from an external terminal such as a PC (personal computer) connected via a network. In addition, the MFP 100 includes, an erasing sheet tray 50 which houses a recording sheet S printed with an erasable ink as an erasable recording material, an erasing portion 52 which erases the image by applying heat of a prescribed temperature on the recording sheet S fed from the erasing sheet tray 50, and a scanner 51 arranged at the upstream side of the erasing portion 52 in the erasing sheet conveying direction, that is an image reading portion which reads in the recording surface before the image is erased, or reads in a management code recorded on the recording sheet S with an original code, a bar code, a QR code or the like indicating an image region which has been erased by a prescribed erasing device in past times as printed region log information. The recording sheet from which the image has been erased in the erasing portion 50 is housed in one of the recording sheet feeding trays 31 to 35 which will become a sheet feeding destination via a storage and sheet feeding portion 60 provided with a sheet sorting mechanism not shown in the drawing, based on the discrimination result of the degradation region described later.

Figure 2:
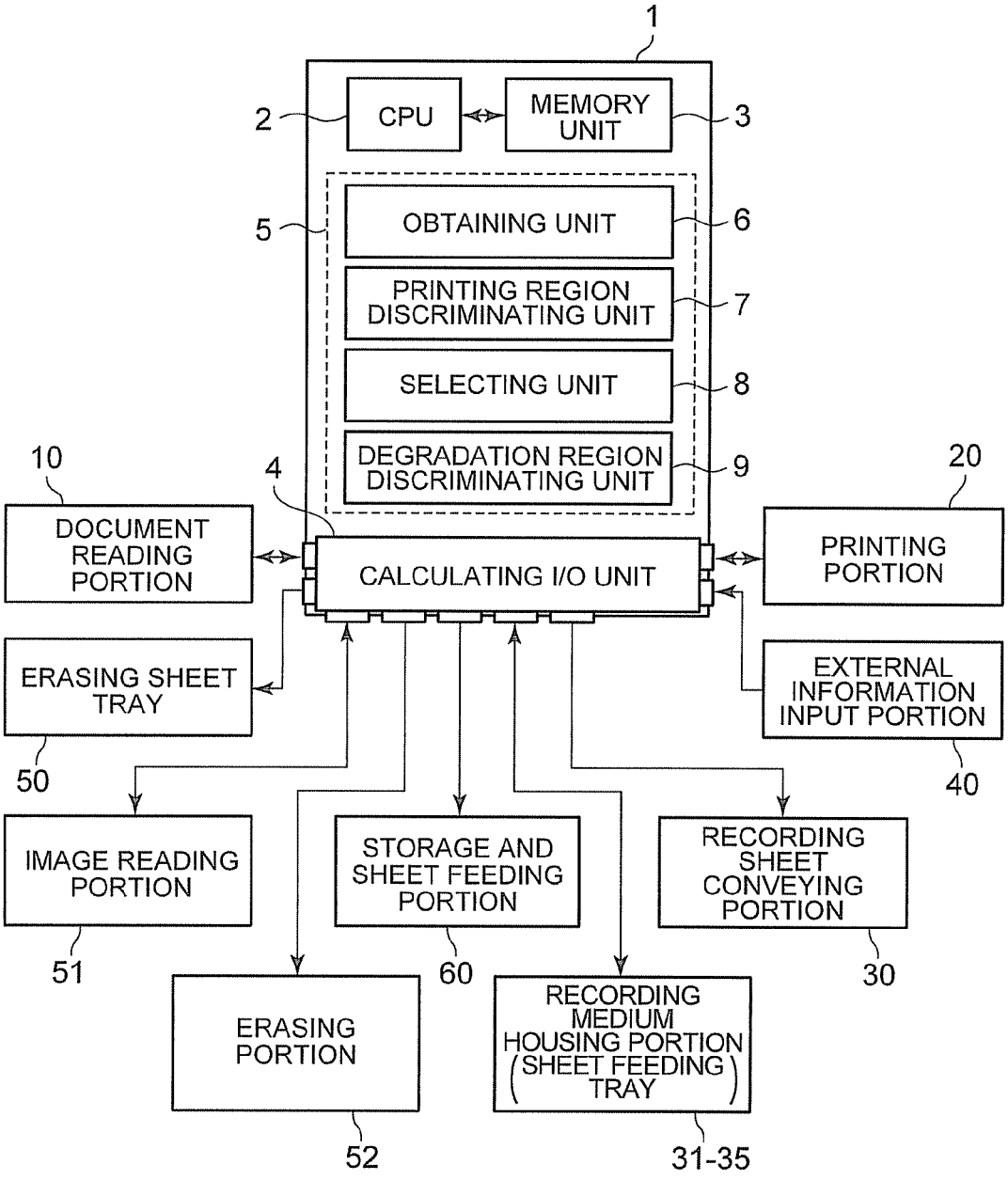
FIG. 2 is a functional block diagram of the image forming apparatus according to the embodiment of the present invention.

FIG. 2 is a function block diagram of the MFP 100 shown in FIG. 1, and the same numbers will be attached to the same portions as the construction shown in FIG. 1. As shown in FIG. 2, the MFP 100 includes a control unit 1 to control generally the whole system, and the control unit 1 includes a CPU 2 to control the image forming operation of the MFP 100, a memory unit 3 composed of a HDD (Hard Disk Drive) which stores the control program and accumulates the image data read in the document reading portion 10, and a ROM (Read Only Memory) and a RAM (Random Access Memory) which stores various set data and parameters as tables and functions as working memories, and so on, a calculating I/O unit 4 which is to be connected to various devices described later, and a function executing unit 5 which reads out and executes the program stored in the memory unit 3.

The calculating I/O unit 4 is connected to each of the devices such as the document reading portion 10, the printing portion 20, the recording sheet conveying portion 30, the sheet feeding trays 31 to 35 as the recording medium housing portion, the external information input portion 40, the erasing sheet tray 50, the image reading portion 51, the erasing portion 52, and the storage and sheet feeding portion 60, transmits the command from the control unit 1 to each of the devices, and in addition, notifies the information from each of the devices to the control unit 1 and transfers the information and data among each of the devices.

The function executing unit 5 includes, an obtaining unit 6 which obtains the image data of the document read out by the document reading portion 10 or the image data such as the print data received via the external information input portion 40, a printing region discriminating unit 7 to discriminate a printing region at the time of printing on the recording sheet P from the image data obtained by this obtaining unit 6, a selecting unit 8 to select one of the sheet feeding trays 31 to 35 in which the recording sheets P have been stored under the condition described later, and a degradation region discriminating unit 9 which discriminates the image to be erased of the recording sheet S printed with the erasable ink, as a degradation region for a predetermined image region unit.

Figure 3:
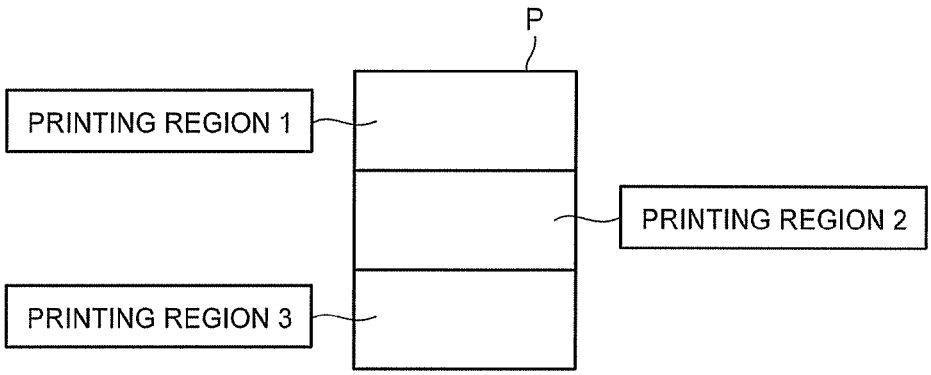
FIG. 3 is a diagram showing printing regions to be recorded on a recording sheet according to the embodiment of the present invention.

FIG. 3 shows printing regions in which an image is printed on a recording sheet as a recording medium in the present embodiment. Specifically a recording sheet composed of one page is divided into three regions from a printing region 1 to a printing region 3, and FIG. 3 indicates which region out of the printing region 1 to the printing region 3, the image data of the document read out by the document reading portion 10 and the print data inputted from the external information input portion 40 are printed. In addition, a method to determine in which region the image which will become an object to be printed is printed will be described later.

The dividing method of the printing region is not limited to dividing into three regions, but the number of divisions may be two or any number not less than 4. In addition, if there is a case in which only one region is present, such a case may be used without departing from the scope of the present invention. In addition, the divided configuration of the printing regions may be rectangular, spherical or other configurations, and the divided configurations may not have the same areas or may not have the same configurations, respectively. In the above-described example, the printing regions have been divided in the vertical direction, but may be divided into the right and left direction, or may be divided in a central portion and a peripheral portion, or an arbitrary dividing method may be used.

Figure 4:
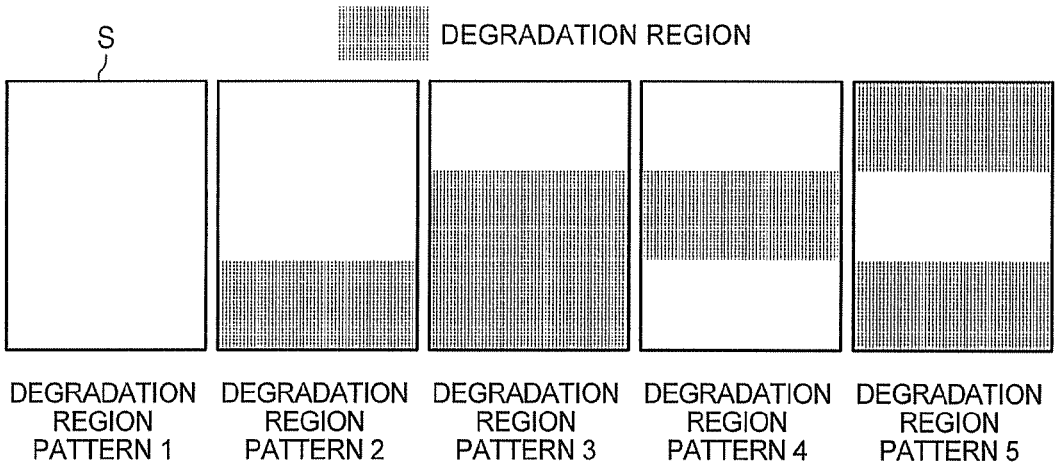
FIG. 4 is a diagram showing positions of degradation regions according to the embodiment of the present invention.

FIG. 4 indicates patterns of the regions where the image has been printed with the erasable ink as the recording material in the present embodiment, and also the regions where the image which will become an object to be erased is printed. In other words, FIG. 4 indicates patterns of erasing regions (hereinafter, this region to be erased will be stated as a degradation region) where the image is to be erased in the erasing portion 52 after feeding the recording sheet S. The degradation which is stated here means the possible degradation of the image, in case that the recording sheet after erasing is reused and the image is printed on the sheet. For example, though the pigment itself is color erased by heat in the erasing performed in the erasing portion 52, the recording material itself remains in the recording sheet, and when printing is again performed on this portion, the thin spot and the bleeding of the printing might be generated. In addition, when the printing and erasing are repeated, the erasing performance is degraded, and thereby the printed image remains slightly on the recording sheet. Accordingly, here, a region where degradation might be caused is referred to as a degradation region in case that the printing level before erasing which will becomes a cause for degradation, that is particularly the image density at the time of printing is higher than a certain definite level and the area is large.

In addition, the degradation region may be judged only by the image density at the time of printing, or may be judged only by the size of the area. In particular, the degradation region may be judged only with a specific color that is the black color out of the YMCK colors, for example, or furthermore, may be evaluated by weighting each color density area of the four colors in the weighted means manner. Parameters except the density may be used. Not the image density area at the time of printing, but the remaining components remaining in the recording sheet may be detected, or the physical roughness of the recording sheet itself or the chemical alteration may be detected. In addition, the degradation region may be evaluated with a plurality of judgments, in such a manner that the judgment level is tightened at the observable portions of the recording sheet and the judgment level is loosened at the peripheral portions. Without being limited to the above-described embodiment, the degradation regions can be set using an arbitrary method without departing from the scope of the present invention.

This degradation region is also divided into three regions composed of an upper stage, a middle stage and a lower stage corresponding to the three divided printing regions shown in FIG. 3. Out of the degradation region patterns each composed of the combination of these degradation regions, as shown in FIG. 4, a pattern in which the degradation is not recognized in any regions is determined as a pattern 1, a pattern in which the degradation region is present only in the lower stage is determined as a pattern 2, and a pattern in which the degradation is present in the middle stage through the lower stage is determined as a pattern 3. In addition a pattern in which the degradation is present only in the middle stage is determined as a pattern 4, and a pattern in which the degradation is present in both the upper stage and the lower stage is determined as a pattern 5. In case that the degradation is present in the whole stages from the upper stage to the lower stage, being not suitable for reuse as a recording sheet, such a sheet is not made an object to be subsequently processed by separately ejecting in a discard tray not shown in the drawing, for example. In addition, a method to discriminate the patterns of the degradation regions will be described in detail later.

In addition, with respect to the degradation pattern, the number of divisions may be any number, as described in the method to divide the printing region. In addition, if there is a case in which only one region is present, such a case may be used without departing from the scope of the present invention. In addition, the divided configuration of the degradation regions may be any configuration, and the area and the configuration of each region may not be the same, respectively. In the above-described example, the degradation region has been divided in the vertical direction, but may be divided in the right and left direction, or may be divided into a central portion and a peripheral portion.

In addition, in the present embodiment, the degradation region patterns are divided in the same manner as printing region patterns corresponding to the printing regions divided by three shown in FIG. 3, but the degradation region pattern may not be the same as the printing region pattern, may be different configurations, or the number of the divisions may be different, or the size thereof may be different.

Next, the relation between the recording medium housing portion and the recording sheet to be housed therein will be described using FIG. 5. FIG. 5 shows the degradation region patterns of the recording sheet to be housed in each of the sheet feeding trays that are recording sheet housing portions, and a user can arbitrarily set in which sheet feeding trays, which recording sheets having the degradation region patterns are housed, respectively, from an operation panel not shown in the drawing. Here, a recording sheet having the degradation region pattern 1 is housed in the sheet feeding tray 31, a recording sheet having the degradation region pattern 2 is housed in the sheet feeding tray 32, a recording sheet having the degradation region pattern 3 is housed in the sheet feeding tray 33, a recording sheet having the degradation region pattern 4 is housed in the sheet feeding tray 34, and a recording sheet having the degradation region pattern 5 is housed in the sheet feeding tray 35. In addition, the data indicating the correspondence relation is held in the memory unit 3 as a table.

FIG. 6 is a flow chart to show an image forming processing according to the present embodiment. In the MFP 100, the program stored in the memory unit 3 is executed under the control of the CPU 2 of the control unit 1. To begin with, the image data read out by the document reading portion 10, or the image data obtained by expanding the print data received via the external information input portion 40 into the bit map is obtained (ACT 1), and the printing region is discriminated, while executing the image processing for printing to the obtained image data. As to a method to discriminate the printing region, the obtained image data is binarized, and a circumscribed rectangular area for each combined pixels in the binarized image obtained by binarization is specified as an image region of the object to be processed, for example. And, by associating each of the specified image regions with the coordinate information, which region the image region that is made as an object to be printed is located in is discriminated, out of the region 1, the region 2, the region 3, a region of (the region 1+the region 2), a region of (the region 1+the region 3), a region of (the region 2+the region 3), and a region of (the region 1+the region 2+the region 3) shown in FIG. 3 (ACT 2). Next, the CPU 2 selects a degradation region pattern not including the printing region discriminated in the ACT 2, with reference to the table shown in FIG. 7 to store the relation between the printing region and the selection order of the degradation patterns, and selects the sheet feeding tray in which the recording sheet having the selected degradation region pattern is housed with reference to the sheet housing table of FIG. 5 (ACT 3). Next, the recording sheet conveying portion 30 transfers the recording sheet which is housed in the selected recording sheet tray to the printing portion 20 (ACT 4), and the printing portion 20 prints the image data which have been dispensed with the prescribed image processing on the conveyed sheet (ACT 5).

Here, the printing region and the selection order of the degradation region patterns shown in FIG. 7 will be described with reference to the degradation region patterns of FIG. 4, in the case of printing the image on the printing region 1 as an example. To begin with, in the case of printing the image on the printing region 1, the recording sheet with the degradation region pattern 3 is firstly selected. This is because, as the degradation is present in the middle stage through the lower stage in the degradation region pattern 3, so long as the image is printed on the printing region 1, that is, only the upper portion of the recording sheet, even if the degradation is present in the middle stage and the lower stage of the recording sheet, the quality of the printed image is not affected. On the other hands, in case that the recording sheet with the degradation pattern 3 which is to be selected firstly is not present, the recording sheet with the degradation pattern 4 is selected as a next candidate. Next, in case that the recording sheet with the degradation pattern 4 is not present, the recording sheet with the degradation pattern 2 is selected, and furthermore in case that the recording sheet with the degradation pattern 2 is not present, the recording sheet with the degradation pattern 1 is lastly selected. As described above, with respect to the selection of the degradation region pattern, the degradation region pattern is selected in order from the degradation region pattern where vain printing region is least generated, in consideration of the efficiency in the case of reusing the recording sheet. In addition, in the remaining printing regions shown in FIG. 7, that is from the region 2 to the region of (the region 1+the region 2+the region 3), the selection of the degradation region patterns will be performed in the same procedure.

On the other hands, in the case of printing the image on the printing region 3, as the image is to be printed on the degradation region at the lower stage only by selecting the recording sheet with the degradation pattern 3 (similarly, in the following pattern 4, the pattern 2), further, the image data is rotated by 180 degrees. In this manner, the printing can be performed on the upper stage where the degradation region is not present. Except this case, rotating the image by 180 degrees is applied to the case where the degradation region pattern 2 is selected in the case of printing the image on the region of (the region 2+the region 3). As described above, a mechanism to reverse the conveying direction of the recording sheet at the upstream side of the printing portion is not required by rotating the image by 180 degrees, and thereby that the apparatus becomes large in size and becomes expensive can be prevented.

In the above-described example, that the printing region coincides with the degradation region on the recording sheet has been avoided by rotating the image data, but if the image data is editable, that the printing region coincides with the degradation region on the recording sheet may be avoided by transforming the printing region with a method of, such as reducing, expanding and transforming. In addition, in an image forming apparatus having a so called "2 in 1" function to print the image data of two pages on one page, that the printing region coincides with the degradation region may be avoided using such function.

Next, a method to erase the image using the erasing portion in the present embodiment and to sort and house the recording sheet from which the image has been erased in the sheet housing portion in accordance with the degradation region pattern will be described using FIG. 8 to FIG. 10.

Figure 8:
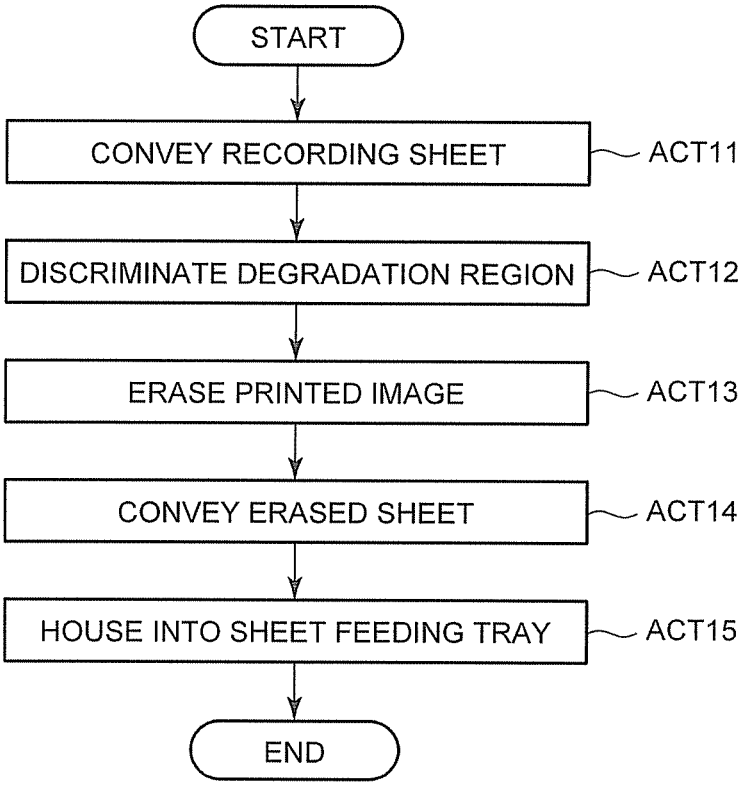
FIG. 8 is a flow chart showing an erasing processing according to the embodiment of the present invention.

FIG. 8 is a flow chart showing a processing to erase an image from the recording sheet on which the image has been printed with an erasable ink that is a recording material in the present embodiment. The recording sheet S printed with the erasable ink is housed into the erasing sheet tray 50 by a user, and then the processing is performed by operating a start button not shown in the drawings.

The recording sheets S for erasing housed in the erasing sheet tray 50 are conveyed toward the erasing portion 52 one by one (ACT 11). The image on the conveyed recording sheet S for erasing is once read out by the scanner 51, and a degradation region is discriminated according to a method to discriminate the degradation region described later (ACT 12). The result of discriminating the degradation region is classified into any one of the degradation pattern 1 to the degradation pattern 5 described before. Next, the recording sheet S for erasing passes through the erasing portion 52 heated at a prescribed temperature and thereby the image is erased (ACT 13), and the recording sheet from which the image has been erased is sent to the storage and sheet feeding portion 60 (ACT 14). In which one of the sheet feeding trays 31 to 35 as the recording medium housing portions, the sheet is housed is determined according to the degradation region discriminated by the ACT 12 with reference to the table of FIG. 5, and the storage and sheet feeding portion 60 houses the sheet in the corresponding sheet feeding tray (ACT 15).

Figure 9:
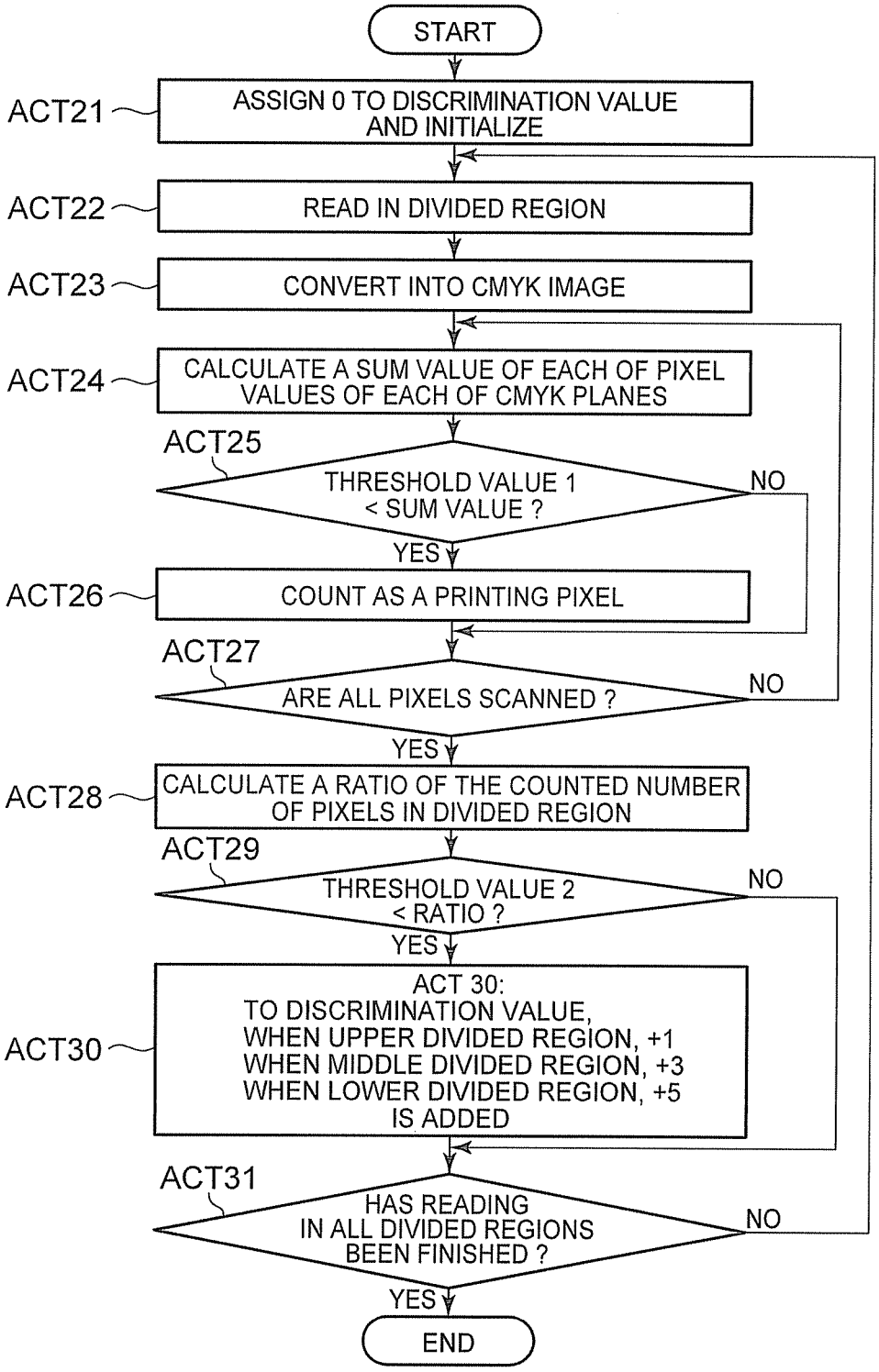
FIG. 9 is a flow chart to discriminate the kind of the degradation region pattern.

FIG. 9 is a flow chart to discriminate patterns of the degradation region at the time of erasing the image based on the image which has been scanned by the scanner 51 that is the image reading portion. In addition, in the case of discrimination, a table of a discrimination value and the degradation region pattern shown in FIG. 10 which has been previously stored in the memory unit 3 is used.

When the flow is started, 0 is assigned to the discrimination value and each of the flags is initialized (ACT 21). Next the image of the upper stage of the divided regions which have been divided into three (ACT 22). As the read in image signal is an RGB signal indicating luminance, the image signal is converted into a CMYK image indicating density information (ACT 23), and the converted CMYK image is broken down into each plane and a sum value of each of the pixel values is calculated (ACT 24). Here, the sum value of each of the pixel values is compared with a certain threshold value 1 (ACT 25), and in case that the sum value is judged to be larger than the threshold value 1, the read in pixel is counted as a printing pixel. On the other hands, in case that the sum value is judged to be smaller than the threshold value 1, the read in pixel is not counted as the printing pixel. The setting of the threshold value 1 is determined according to the image density which is assumed to be the image degradation after erasing, in case that the image which has been printed using the erasable ink is erased in the present embodiment. Subsequently, whether the scanning has been finished for the whole pixels in the firstly selected region is judged (ACT 27), and the counting of the printing pixels will be repeated till the scanning of the whole pixels is finished.

Next, a ratio of the number of printed pixels counted in the ACT 26 to the number of the whole pixels in the read in divided region, that is the region corresponding to the upper stage here, is calculated (ACT 28). Then the ratio of the number of the pixels is compared with a previously set threshold value 2 (ACT 29), and in case that the ratio of the number of the pixels is larger than the threshold value 2, +1 is assigned to the discrimination value in case that the region in which the processing is performed now is the upper stage divided region, +3 is assigned in the case of the middle stage divided region, and +5 is assigned in the case of the lower stage divided region (ACT 30). And in case that the ratio of the number of the pixels is smaller than the threshold value 2, no score is added to the discrimination value, and the discrimination value remains as the intact value. As the ratio of the threshold value 2 indicates a ratio of an area where the pixels having a density of not less than a certain definite value to the whole area of the relevant region, and in the case of exceeding the prescribed area, a score is added to the discrimination value to mean that the degradation region is present. Subsequently, whether the reading of the images for the whole three divided regions has been finished is judged (ACT 31), and the addition of the discrimination value will be repeated till the reading of the images for the whole regions is finished.

The degradation region of the recording sheet for erasing can be discriminated from the discrimination value which has been added in this manner, using a table of the degradation region pattern and the discrimination value in FIG. 10. That is, when the discrimination value is 0, the degradation region pattern is discriminated as the degradation region pattern 1, when the discrimination value is 1 or 5, discriminated as the degradation region pattern 2, when the discrimination value is 4 or 8, discriminated as the degradation region pattern 3, when the discrimination value is 3, discriminated as the degradation region pattern 4, and when the discrimination value is 6, discriminated as the degradation region pattern 5.

As another method to discriminate the degradation region pattern in the present embodiment, there is a method to utilize a management code. For example, an image region which was erased by a prescribed erasing device in past times is converted into an original code, a bar code or a QR code as printed region log information and is stored in the recording sheet S, and these management codes are read out with the scanner 51. This code read out information which has been read out like this is sent to the CPU 2 via the calculating I/O unit 4, and the degradation region of the relevant recording sheet S can be discriminated by analyzing the degradation region information in the CPU 2. In addition, a final degradation region can be determined by combining the method to read out the image data shown in FIG. 9 and this method to read out the management code. In case that the degradation region determination result is determined as the degradation region pattern 2 in FIG. 10 and the result by the printed log information is the degradation pattern 4, for example, the final degradation region can also be determined as the degradation pattern 3 by mixing these two patterns. If the past erasing history information is utilized in this manner, the degradation region can be discriminated more surely.

In addition, the present invention is not limited to the above-described embodiment. The printing region and the degradation region have been divided by three, respectively, but the number of the divisions may be not less than three divisions. Furthermore, the division direction may be the sub scanning direction or may be the main scanning direction for the recording sheet conveying direction.

In addition, an ink jet recording system is used as the printing system in the present embodiment, but an electro photographic system may be used, and in such a case, an erasable toner has only to be used in place of the erasable ink. In addition, as a method to erase the image, a method to utilize heat or to irradiate with light may be used.

In addition, as a method to discriminate the printing region, the method to discriminate the degradation region pattern shown in FIG. 9 may be used.

In addition, the recording sheets may not be sorted into a plurality of cartridges for each of the degradation regions, but the used recording sheet may be housed in one cartridge. In this case, the erased degradation region is not more than a half of the recording sheet and the printing region is also not more than the half thereof, the used recording sheet is used. In addition, if the degradation region is not less than a half of the recording sheet, the used recording sheet is ejection processed and a new plain paper is used. Furthermore, in case that the printing region is not less than the half, a new plain paper may be used from the beginning.

In addition, in place of using a new plain paper which has not been used, the reused paper is reversed from front to back and the printing may be made on the back side.

The housing portion to load the sheets may not be selected by the selecting portion, but the used sheets are simply conveyed in the loaded order, and the order of the image to be printed may be interchanged. If a printing region on a first page includes a degradation region of the recording sheet scheduled to be conveyed and a printing region on a second page does not include a degradation region of the recording sheet scheduled to be conveyed, for example, the printing order may be changed such that the second page is printed firstly and then the first page is printed.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus, comprising:

an image reading portion to read out an image recorded on the recording medium;

an erasing portion, disposed at a downstream side of the image reading portion in a recording medium conveying direction, to erase the image recorded on a recording medium using an erasable recording material;

a degradation region discriminating unit to discriminate the image to be erased as degradation regions where a pigment of the erasable recording material is decolorized and the erasable recording material remains in the recording medium, based on the read out image;

a plurality of recording medium housing portions, disposed at a downstream side of the erasing portion in the recording medium conveying direction, to house recording mediums from which the image has been erased respectively for the degradation regions;

an obtaining unit to obtain image data;

a printing region discriminating unit to discriminate a printing region at the time of printing from the obtained image data to the recording medium;

a selecting unit to select the recording medium housing portion in which the recording medium not including the degradation region corresponding to the printing region discriminated by the printing region discriminating unit is housed from a plurality of the recording medium housing portions; and a printing portion to print the image data obtained in the obtaining unit on the recording medium fed from the recording medium housing portion which is selected by the selecting unit.

2. The image forming apparatus as recited in claim 1, wherein:

the recording medium housing portion to be selected by the selecting unit is selected from arrangements of the printing region and the degradation region based on a predetermined priority order.

3. The image forming apparatus as recited in claim 1, wherein:

the recording medium housing portion to be selected by the selecting unit houses the recording medium which does not include the printing region, in the case of rotating and printing the image data obtained by the obtaining unit, in the degradation region.

4. The image forming apparatus as recited in claim 1, wherein:

the degradation region discriminating unit to discriminate the image to be erased of the recording medium as the degradation region for a predetermined image region unit; and further comprising:

a recording medium conveying portion to convey the recording medium from which the image has been erased by the erasing portion to the one recording medium housing portion selected from a plurality of the recording medium housing portions based on the degradation region discrimination result; and a recording medium feeding portion to feed the recording medium from the selected recording medium housing portion by the selecting unit to the printing portion.

5. The image forming apparatus as recited in claim 4, wherein:

the degradation region discriminating unit assumes the degradation region based on a density and an area of the image to be erased which has been read out in the image reading portion at the predetermined image region.

6. An image forming method, comprising:

reading out an image recorded on a recording medium by an image reading portion;

erasing the image recorded on the recording medium using an erasable recording material by an erasing portion disposed at an downstream side of the image reading portion in a recording medium conveying direction;

discriminating the image to be erased as degradation regions where a pigment of the erasable recording material is decolorized and the erasable recording material remains in the recording medium, based on the read out image;

housing recording mediums from which the image has been erased respectively for the degradation regions in a plurality of recording medium housing portions disposed at a downstream side of the erasing portion in the recording medium conveying direction;

obtaining image data;

discriminating a printing region at the time of printing from the obtained image data to a recording medium;

selecting one recording medium housing portion in which the recording medium not including the degradation region corresponding to the discriminated printing region is housed from a plurality of the recording medium housing portions; and printing the obtained image data on the recording medium fed from the selected recording medium housing portion by a printing portion.

7. The image forming method as recited in claim 6, wherein:

the recording medium housing portion to be selected is selected from arrangements of the printing region and the degradation region based on a prescribed priority order.

8. The image forming method as recited in claim 6, wherein:

the recording medium housing portion to be selected houses the recording medium which does not include the printing region in the case of rotating and printing the obtained image data in the degradation region.

9. The image forming method as recited in claim 6, wherein:

the discriminating unit to discriminate the image to be erased of the recording medium as the degradation region for a predetermined image region unit; and further comprising:

conveying the recording medium from which the image has been erased to the one recording medium housing portion selected from a plurality of the recording medium housing portions based on the degradation region discrimination result; and feeding the recording medium from the selected recording medium housing portion by the selecting unit to the printing portion.

10. The image forming method as recited in claim 9, wherein:

in the discrimination of the degradation region, the degradation region is assumed based on a density and an area of the image to be erased at the predetermined image region.

11. An image forming apparatus to form an image on a recording medium which is reusable by erasing an image, comprising;

an image reading portion to read out an image recorded on the recording medium;

an erasing portion, disposed at a downstream side of the image reading portion in a recording medium conveying direction, to erase the image recorded on a recording medium using an erasable recording material;

a degradation region discriminating unit to discriminate the image to be erased as degradation regions where a pigment of the erasable recording material is decolorized and the erasable recording material remains in the recording medium, based on the read out image;

a plurality of recording medium housing portions, disposed at a downstream side of the erasing portion in the recording medium conveying direction, to house recording mediums from which the image has been erased;

an obtaining unit to obtain image data to form the image on the recording medium having the decolorized degradation region;

an image region discriminating unit to discriminate a region in which the image is formed based on the image data; and a control unit to form the image in a non degradation region on the recording medium which is housed in one recording medium housing portion selected from a plurality of the recording medium housing portions when the degradation region on the recording medium is not included in the image forming region which is discriminated by the image region discriminating unit.

12. The image forming apparatus of claim 11, further comprising:

a selecting unit to select the recording medium housing portion in which the recording medium not including the degradation region corresponding to the image forming region discriminated by the image region discriminating unit is housed from a plurality of the recording medium housing portions;

wherein the image of the image data obtained in the obtaining unit is formed on the recording medium fed from the recording medium housing portion which is selected by the selecting unit.

13. The image forming apparatus of claim 11, wherein:

the recording medium not including the degradation region corresponding to the image forming region discriminated by the image region discriminating unit is selected, and the image is formed on the recording medium.

14. The image forming apparatus of claim 11, wherein:

the image region discrimination unit divides the recording medium into a plurality of regions and discriminates whether the image is formed in the divided regions based on the obtained image data; and the recording medium not including the degradation region in the divided region in which the image is to be formed, is selected, and the image is formed on the recording medium.

15. The image forming apparatus of claim 12, wherein:

the image region discrimination unit divides the recording medium into a plurality of regions and discriminates whether the image is formed in the divided regions based on the obtained image data; and the recording mediums are respectively housed in the recording medium housing portions for degradation region patterns which are divided by the substantially same pattern as the divided regions discriminated by the image region discriminating unit.

16. The image forming apparatus as recited in claim 11, wherein:

with respect to the degradation region, the degradation region is assumed based on a density and an area of the image to be erased at the image region.

17. The image forming apparatus as recited in claim 16, wherein:

with respect to the degradation region, the number of pixels having a density not less than a prescribed value is measured, and when a ratio of the number of the pixels in the prescribed region is larger than a prescribed value, the region is assumed to be degraded.

18. The image forming apparatus as recited in claim 12, wherein:

the recording medium housing portion to be selected by the selecting unit is selected from arrangements of the image forming region and the degradation region based on a prescribed priority order.

19. The image forming apparatus as recited in claim 18, wherein:

the recording medium housing portion to be selected by the selecting unit houses the recording medium which does not include the image forming region, in the case of rotating and printing the image data obtained by the obtaining unit, in the degradation region.

* * * * *